US006895777B2

(12) United States Patent
Kim et al.

(10) Patent No.: US 6,895,777 B2
(45) Date of Patent: May 24, 2005

(54) FRONT SUCTION/DISCHARGE TYPE OUTDOOR UNIT FOR AIRCONDITIONER

(75) Inventors: In-Gyu Kim, Jinhae-Shi (KR); Young-Ju Bae, Changwon-Shi (KR); Jac-Hyung Koo, Changwon-Shi (KR); Byung-Il Park, Changwon-Shi (KR); Kyeong-Ho Kim, Changwon-Shi (KR); Yang-Ho Kim, Changwon-shi (KR); Young-Ho Hong, Kimbae-Shi (KR); Kyeong-Wook Heo, Changwon-shi (KR); Kang-Wook Cha, Changwon-shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/451,776

(22) PCT Filed: Apr. 18, 2003

(86) PCT No.: PCT/KR03/00795

§ 371 (c)(1),
(2), (4) Date: Jun. 26, 2003

(87) PCT Pub. No.: WO03/068543

PCT Pub. Date: Aug. 21, 2003

(65) Prior Publication Data

US 2004/0163407 A1 Aug. 26, 2004

(30) Foreign Application Priority Data

Feb. 26, 2003 (KR) ..... 10-2003-0012097

(51) Int. Cl.[7] ..... F25D 17/06

(52) U.S. Cl. ..... 62/428; 62/305; 62/507

(58) Field of Search ..... 62/428, 259.1, 62/277, 279, 263, 305, 507

(56) References Cited

U.S. PATENT DOCUMENTS 6,032,479 A * 3/2000 Choi et al. ..... 62/262
6,701,741 B2 3/2004 Liu ..... 62/429
2002/0112495 A1 8/2002 Campbell ..... 62/259.1

FOREIGN PATENT DOCUMENTS

| | | | | |
|---|---|---|---|---|
| EP | 1248049 | A2 * | 10/2002 | ..... 62/429 |
| JP | S54-18043 | | 2/1979 | |
| JP | 54-18043 | | 2/1979 | |
| JP | 03-213928 | | 9/1991 | |
| JP | 06-101873 | | 4/1994 | |
| JP | 2002-310496 | | 10/2002 | |
| KR | 10-2002-0039485 | A | 5/2002 | |
| KR | 10-2002-0097379 | A | 12/2002 | |
| WO | WO 01/51859 | A1 | 7/2001 | |

OTHER PUBLICATIONS

Korean Office Action, mailed Sep. 7, 2004, citing the above references.

* cited by examiner

*Primary Examiner*—Melvin Jones
(74) *Attorney, Agent, or Firm*—Fleshner & Kim, LLP

(57) ABSTRACT

The present invention relates to a front suction/discharge type outdoor unit for an air conditioner which can solve problems due to increased capacity and decreased suction air. The front suction/discharge type outdoor unit includes an outdoor unit casing having its one surface externally opened and its other surfaces closed, the inside of which being divided into a suction unit and a discharge unit, a compressor installed in the suction unit of the outdoor unit casing, for compressing a refrigerant gas supplied from an indoor unit through pipe lines, an air-cooled condenser positioned in the suction unit of the outdoor unit casing to face one surface and face two surfaces contacting one surface and being positioned in parallel among the other surfaces, for inducing external air sucked through one surface to gaps from the facing surfaces for heat exchange, and condensing the refrigerant gas from the compressor by external air sucked in the direction of one surface and the facing surfaces, and a cooling fan installed in the discharge unit of the outdoor unit casing, for supplying external air to the air-cooled condenser, and discharging heat exchanged air.

38 Claims, 9 Drawing Sheets

FRONT SUCTION/DISCHARGE TYPE OUTDOOR UNIT FOR AIRCONDITIONER

TECHNICAL FIELD

The present invention relates to an outdoor unit for an air conditioner, and more particularly to, a front suction/discharge type outdoor unit for an air conditioner.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication No. 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between the louver plates.

In addition, Japanese Laid-Open Patent Publication No. 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

Recently, the outdoor unit needs to improve its heat exchange efficiency due to increased air conditioning capacity. However, the aforementioned front suction/discharge type outdoor unit sucks air through the front surface, namely one surface, and thus has a smaller suction unit than a conventional three-surface suction type outdoor unit, which decreases heat exchange efficiency. Nevertheless, there has never been suggested a structure or alignment for efficiently improving heat exchange efficiency in the front suction/discharge type outdoor unit which inevitably decreases an external air suction area.

DISCLOSURE OF THE INVENTION

An object of the present invention is to improve heat exchange efficiency by efficiently inducing external air sucked through a front surface, namely one surface due to a decreased suction unit area to an air-cooled condenser.

Another object of the present invention is to improve heat exchange efficiency by converting capacity of an outdoor unit sucking air from three sides and discharging it to a top surface into a front suction/discharge type, and externally discharging sucked external air through an air-cooled condenser.

Yet another object of the present invention is to convert capacity of an outdoor unit sucking air from three sides and discharging it to a top surface into a front suction/discharge type, and to align an air-cooled condenser in a restricted space of an outdoor unit casing to efficiently suck external air.

Yet another object of the present invention is to convert capacity of an outdoor unit sucking air from three sides and discharging it to a top surface into a front suction/discharge type, and to modify a structure of an air-cooled condenser to efficiently suck external air.

In order to achieve the above-described objects of the invention, there is provided a front suction/discharge type outdoor unit for an air conditioner, including: an outdoor unit casing having its one surface externally opened and its other surfaces closed, the inside of which being divided into a suction unit and a discharge unit; a compressor installed in the suction unit of the outdoor unit casing, for compressing a refrigerant gas supplied from an indoor unit through pipe lines; an air-cooled condenser positioned in the suction unit of the outdoor unit casing to face one surface and face two surfaces contacting one surface and being positioned in parallel among the other surfaces, for inducing external air sucked through one surface to gaps from the facing surfaces for heat exchange, and condensing the refrigerant gas from the compressor by external air sucked in the direction of one surface and the facing surfaces; and a cooling fan installed in the discharge unit of the outdoor unit casing, for supplying external air to the air-cooled condenser, and discharging heat exchanged air.

Here, the outdoor unit further includes a first supporting member for fixedly supporting the air-cooled condenser on the facing surfaces at the top end of the air-cooled condenser in the direction of the discharge unit. In addition, the outdoor unit further includes a second supporting member for fixedly supporting the air-cooled condenser on the facing surfaces at both ends of the air-cooled condenser.

Preferably, one end of the air-cooled condenser is adhered to the surface facing one surface, and the outdoor unit further includes a second supporting member for fixedly supporting the air-cooled condenser on the surface facing one surface at the other end of the air-cooled condenser, or one end of the air-cooled condenser is adhered to the surface facing one surface, and the outdoor unit further includes a second supporting member for fixedly supporting the air-cooled condenser on the surface adjacent to the surface facing one surface and adjacent to one surface at the other end of the air-cooled condenser.

Preferably, the outdoor unit casing is divided into a suction casing corresponding to the suction unit, and a discharge casing corresponding to the discharge unit, and the first supporting member is positioned to contact both the suction casing and the discharge casing.

Preferably, the first and second supporting members are fixedly adhered to the surfaces of the suction casing, and the lower end of the air-cooled condenser is adhered to one of the other surfaces, so that whole external air sucked through one surface can pass through the air-cooled condenser.

The air-cooled condenser preferably has a rounded part, and more preferably has predetermined gaps from the facing surfaces of the suction casing. In addition, the air-cooled condenser preferably has a 'U' shaped cross section, and more preferably, a rounded value of the 'U' shape is greater than a size of the gap by at least two times.

According to another aspect of the invention, a front suction/discharge type outdoor unit for an air conditioner includes: an outdoor unit casing having its one surface externally opened and its other surfaces closed, the inside of which being divided into a suction unit and a discharge unit; a compressor installed in the suction unit of the outdoor unit casing, for compressing a refrigerant gas supplied from an indoor unit through pipe lines; an air-cooled condenser being positioned in the suction unit of the outdoor unit casing to face one surface and face two surfaces contacting one surface and being positioned in parallel among the other surfaces, having its both ends adhered to at least one of the other surfaces, inducing external air sucked through one surface to gaps from the facing surfaces for heat exchange, and condensing the refrigerant gas from the compressor by external air sucked in the direction of one surface and the facing surfaces; and a cooling fan installed in the discharge unit of the outdoor unit casing, for supplying external air to the air-cooled condenser, and discharging heat exchanged air.

According to another aspect of the invention, a front suction/discharge type outdoor unit for an air conditioner includes: an outdoor unit casing having its one surface externally opened and its other surfaces closed, the inside of which being divided into a suction unit and a discharge unit; a compressor installed in the suction unit of the outdoor unit casing, for compressing a refrigerant gas supplied from an indoor unit through pipe lines; an air-cooled condenser being positioned in the suction unit of the outdoor unit casing to face one surface and face two surfaces contacting one surface and being positioned in parallel among the other surfaces, having a rounded part, inducing external air sucked through one surface to gaps from the facing surfaces for heat exchange, and condensing the refrigerant gas from the compressor by external air sucked in the direction of one surface and the facing surfaces; and a cooling fan installed in the discharge unit of the outdoor unit casing, for supplying external air to the air-cooled condenser, and discharging heat exchanged air.

BEST MODE FOR CARRYING OUT THE INVENTION

A front suction/discharge type outdoor unit for an air conditioner in accordance with the present invention will now be described in detail with reference to the accompanying drawings.

Figure 1:
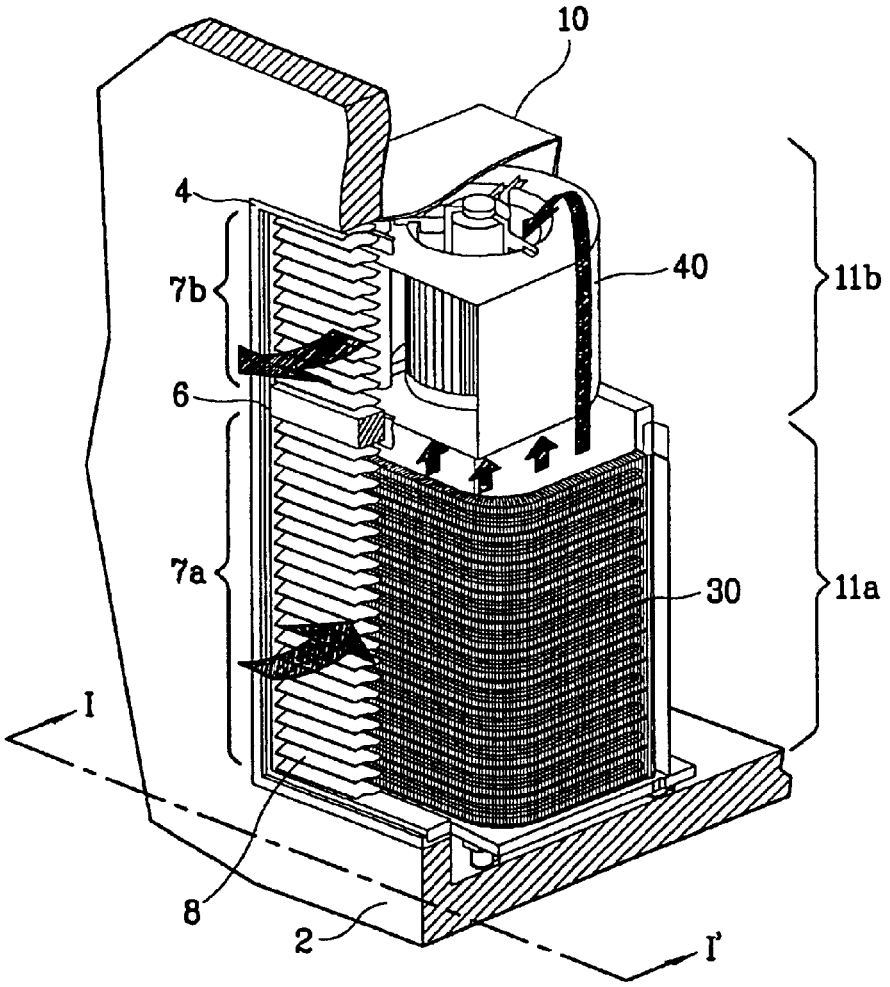
FIG. 1 is a partially-cut perspective-sectional view illustrating a front suction/discharge type outdoor unit for an air conditioner in accordance with a preferred embodiment of the present invention.
Figure 2:
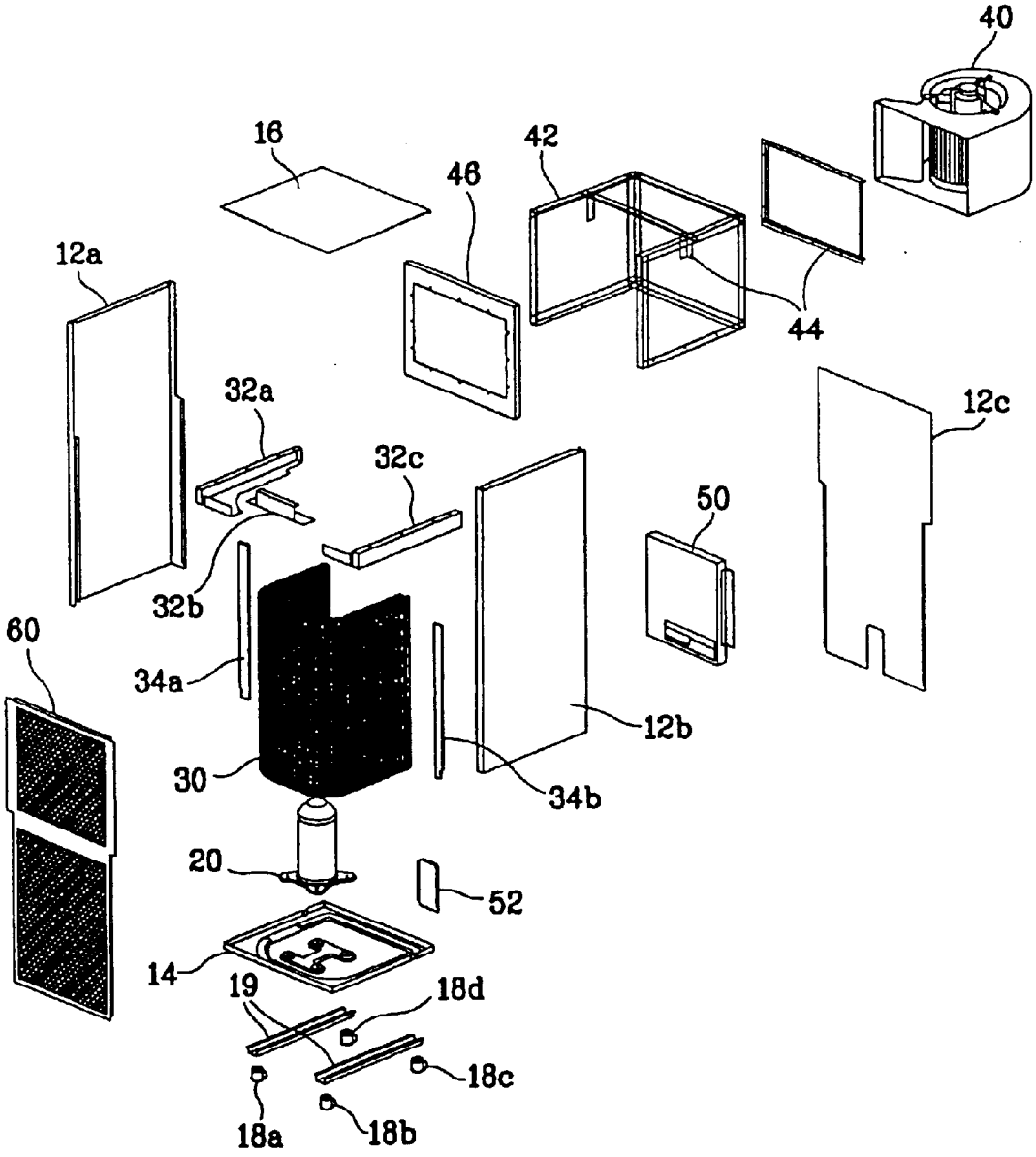
FIG. 2 is a perspective view illustrating disassembly of the outdoor unit of FIG. 1.

FIGS. 1 and 2 are structure views illustrating the front suction/discharge type outdoor unit for the air conditioner in accordance with a preferred embodiment of the present invention.

An external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8.

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades are easily understood by ordinary people skilled in the art to which the present invention pertains. It is also possible to determine the air suction/discharge direction in consideration of an external environment, and to open and maintain the louver blades 8 in a predetermined direction.

On the other hand, the outdoor unit 10 fixedly installed at the inside of the outer wall 2 of the building to contact the external frame 4 and/or internal frame 6 includes an outdoor unit casing composed of components of FIG. 2. In addition, outdoor unit components of FIG. 2 are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, three side covers 12*a*, 12*b* and 12*c*, a bottom cover 14 and a top cover 16 are closed to form a rectangular parallelepiped. The outdoor casing includes a suction casing corresponding to the suction unit 11*a* and a discharging casing corresponding to a discharge unit 11*b* which can be separated and coupled. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two legs 18*a* and 18*b* positioned in the forward direction (toward building outer wall) among the leg members 18*a*, 18*b*, 18*c* and 18*d* further include screws (not shown), it is much easier to transfer the heavy load outdoor unit 10.

Figure 3A:
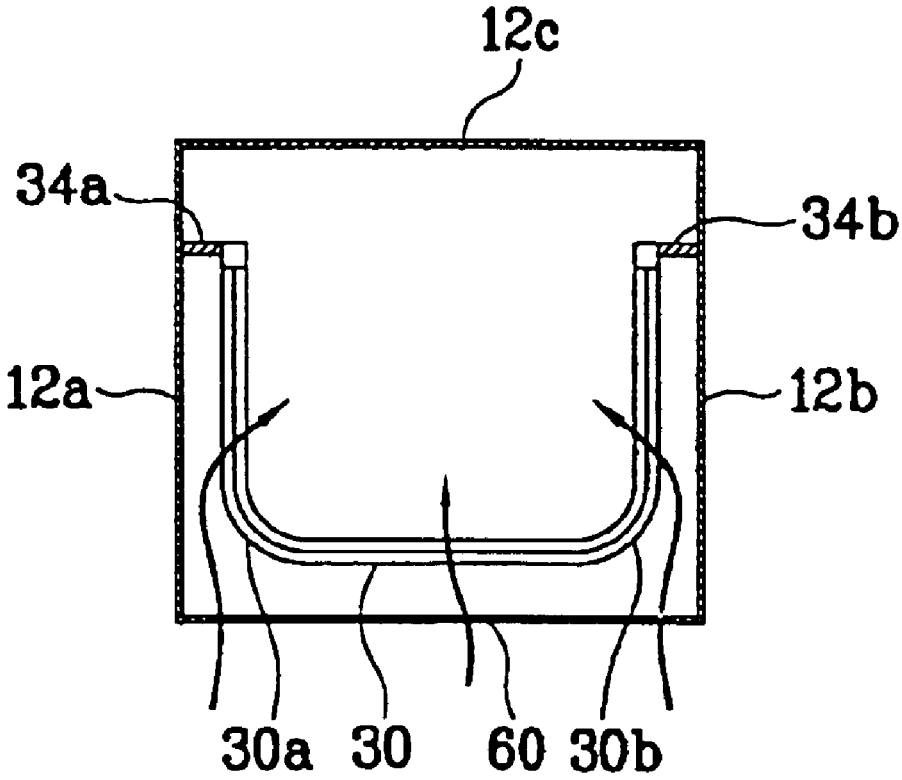
FIGS. 3A to 3C are views illustrating flows of sucked external air in a condenser-mounted structure of the outdoor unit of FIG. 1.
Figure 3B:
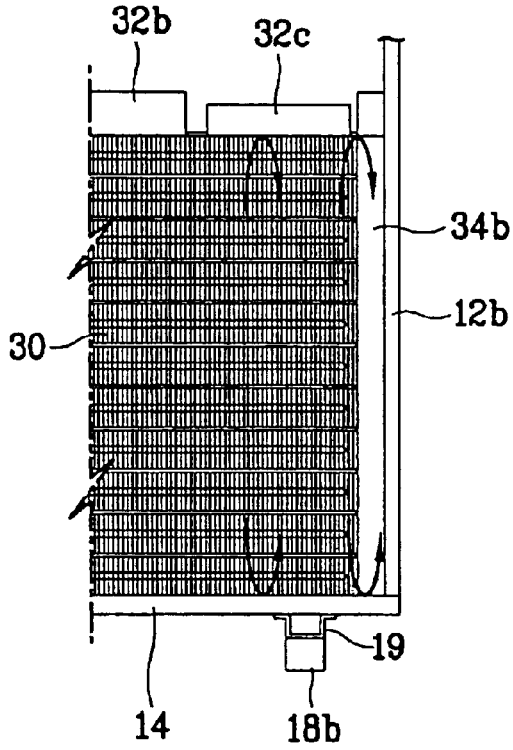
Figure 3C:
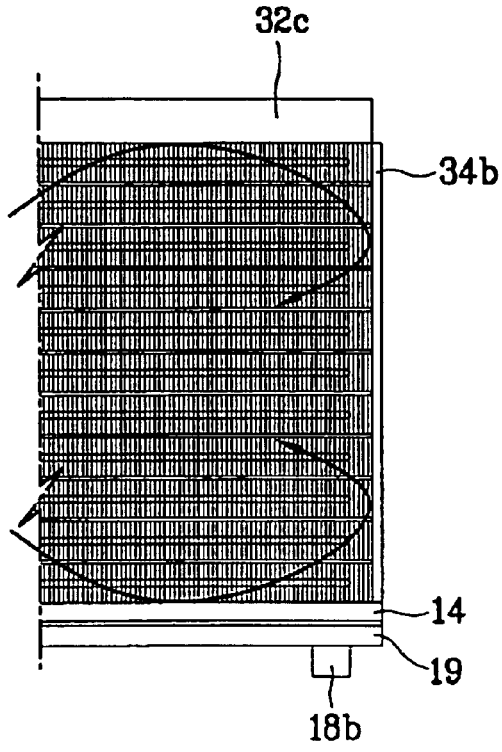

In the outdoor unit suction unit 11*a*, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. The air-cooled condenser 30 has a 'U' shaped cross section facing one opened side facing the suction area 7*a* of the internal frame 6, and facing the two sides contacting one opened side and being positioned in parallel, namely the side covers 12*a* and 12*b*, and also has gaps from the side covers 12*a* and 12*b*. Therefore, external air sucked through the suction area 7*a* directly passes through the condenser 30, or passes through the condenser 30 via the gaps between the side covers 12*a* and 12*b* and the condenser 30. Such constitution is illustrated in FIGS. 3A to 3C, and will later be explained. In the air-cooled condenser 30, a plurality of condenser pipe lines are formed in a zigzag shape between a plurality of condenser fins. The structure and shape of the air-cooled condenser 30 have been publicly known, and thus are not shown in detail.

A refrigerant gas compressed by the compressor 20 is transmitted through the pipe lines of the condenser 30, its condensation heat is removed by externally-supplied air, and condensed. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

In the outdoor unit discharge unit 11*b*, a cooling fan 40 for supplying external air to the air-cooled condenser 30 through the suction area 7*a*, and discharging heat exchanged air through the discharge area 7*b* is fixedly installed on the side covers 12*a*, 12*b* and 12*c* and the top cover 16 by a cooling fan supporting member 42 and a cooling fan bracket 44. One example of the cooling fan 40 is a sirocco fan. Reference numeral 46 denotes a fan front installed in front of the cooling fan 40.

A control box 50 for controlling the operation of the outdoor unit 10 is installed at the inside of the side cover 12*c* composing the rear surface among the side covers, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

A mesh shaped front grill 60 is additionally installed on the front surface of the outdoor unit 10, namely one side facing the suction area 7*a* and the discharge area 7*b* of the internal frame 6 to prevent invasion of animals (for example, rats).

FIGS. 3A to 3C are views illustrating flows of sucked external air in the condenser-mounted structure of the outdoor unit of FIG. 1.

FIG. 3A is a cross-sectional view illustrating the outdoor unit 10 taken along line I–I' of FIG. 1. The condenser brackets 34*a* and 34*b* fixedly support the condenser 30 on the side covers 12*a* and 12*b* at both ends of the condenser 30 with a predetermined size of gaps, and thus external air sucked through one opened side is guided to pass through the condenser 30 through the gaps between the side covers 12*a* and 12*b* and the condenser 30 as indicated by arrows of FIG. 3A.

In addition, the condenser 30 includes rounded bending units 30*a* and 30*b* so that external air can pass through the condenser 30 easier than when it is sucked through one opened side. Preferably, the condenser 30 is formed in a 'U' shape.

FIG. 3B is a partial front view illustrating the outdoor unit 10 which does not include the front grill 60, and FIG. 3C is a partial side view illustrating the outdoor unit 10 which does not include the side cover 12*b*.

Referring to FIG. 3B, the condenser covers 32*a*, 32*b* and 32*c* fixedly support the condenser 30 on the side covers 12*a* and 12*b* at the highest end of the condenser 30, so that external air sucked through one opened side can be induced to the condenser 30 by the condenser covers 32*a*, 32*b* and 32*c* and the bottom cover 14.

As shown in FIG. 3C, external air sucked through the gaps between the side covers 12*a* and 12*b* and the condenser 30 is induced to the condenser 30 by the condenser covers 32*a*, 32*b* and 32*c*, the bottom cover 14 and the condenser brackets 34*a* and 34*b*.

However, as described above, when the outdoor unit casing is divided into the suction casing corresponding to the suction unit 11*a* and the discharge casing corresponding to the discharge unit 11*b*, the condenser covers 32*a*, 32*b* and 32*c* must be fixedly supported on the suction casing contacting the discharge casing. That is, the condenser covers 32*a*, 32*b* and 32*c* and the condenser brackets 34*a* and 34*b* are fixedly adhered to the side covers 12*a* and 12*b* and/or the suction casing (when the outdoor unit casing is divided), to guide external air sucked through the suction area 7*a* of the internal frame 6 to pass through the condenser 30, and to prevent external air from being externally leaked not via the condenser 30.

The operation of the front suction/discharge type outdoor unit for the air conditioner will now be explained.

The refrigerant gas inputted from the indoor unit through the refrigerant pipe lines of the valve assembly 52 is compressed in the compressor 20 and supplied to the condenser 30. Because the cooling fan 40 is operated, external air sucked through the gaps between the louver blades 8 of the suction area 7*a* evenly passes through gaps between the fins formed on the three surfaces of the 'U' shaped condenser 30 through the wind path of the condenser covers 32*a*, 32*b* and 32*c* and the condenser brackets 34*a* and 34, increases its temperature by taking condensation heat from the refrigerant gas flowing through the condenser pipe lines inserted between the fins, passes through the cooling fan 40, and is externally discharged through the gaps between the louver blades 8 of the discharge area 7*b*.

Figure 4A:
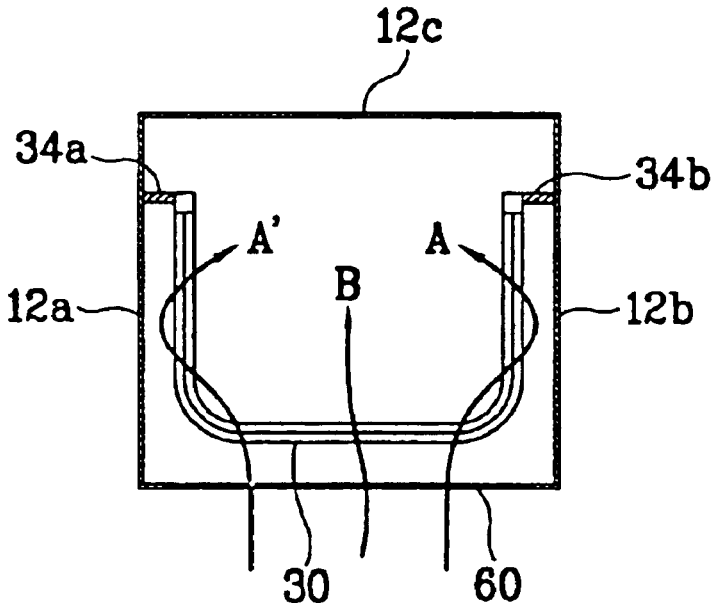
FIGS. 4A and 4B are views illustrating flows of sucked external air according to a rounded value of a condenser of the outdoor unit in accordance with the present invention.
Figure 4B:
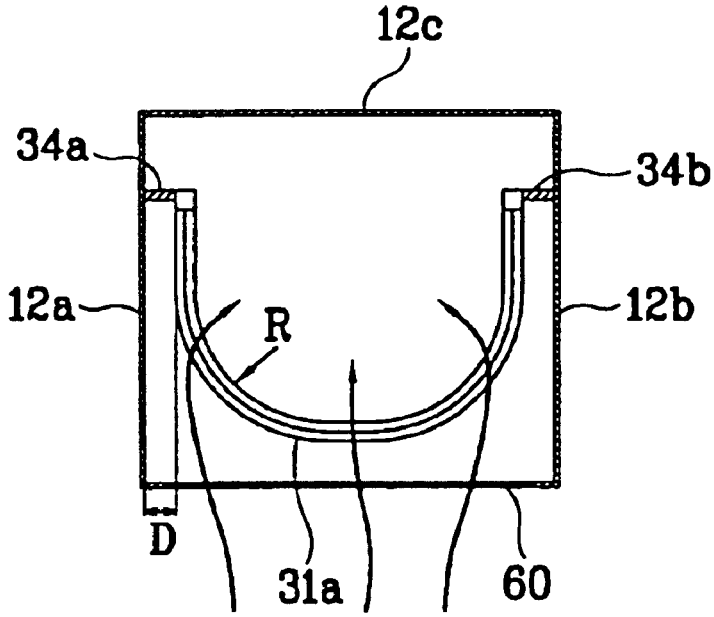

FIGS. 4A and 4B are views illustrating flows of sucked external air according to a rounded value R of the condenser of the outdoor unit in accordance with the present invention.

As indicated by arrows A and A' of FIG. 4A, when R which is a rounded value of the cross section of the condenser 30 is small, air heated due to heat exchange in the condenser 30 flows backward to the gaps between the side covers 12*a* and 12*b* and the condenser 30, and re-passes through the gaps between the fins of the condenser 30, to reduce heat exchange efficiency. Accordingly, the present inventors made researches on relation between D which is a gap distance between the side covers 12*a* and 12*b* and the condenser 30 and R which is a rounded value of the condenser 30 by numerical value analysis, and found out that R must be greater than D by at least two times. In this case, as depicted in FIG. 4B, air heated in the condenser 30 does not flow backward to the gaps between the side covers 12*a* and 12*b* and the condenser 30. If R is increased more, there is no possibility of flowing backward. However, a length of the pipe lines of the condenser 30 per unit area decreases, which reduces heat exchange efficiency. Here, R is defined as a radius of an arc of the bending unit of the condenser 30.

FIGS. 5A to 5F are views illustrating various examples of the shape and mounting structure of the condenser of the outdoor unit in accordance with the present invention.

Figure 5A:
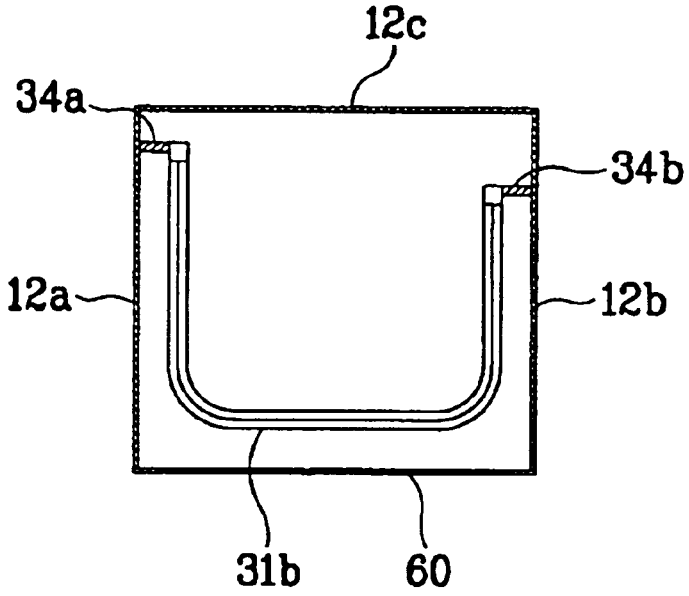
FIGS. 5A to 5F are views illustrating various examples of the shape and mounting structure of the condenser of the outdoor unit in accordance with the present invention.

As illustrated in FIG. 5A, the condenser 30 mounted on the outdoor unit 10 may not be symmetrical according to alignment of elements of the outdoor unit 10, and is fixedly supported on the side covers 12*a* and 12*b* and the bottom cover 14 by using the condenser covers (not shown) and the condenser brackets 34*a* and 34*b*. The condenser 30 can be used to appropriately align the components of the outdoor unit 10.

Figure 5B:
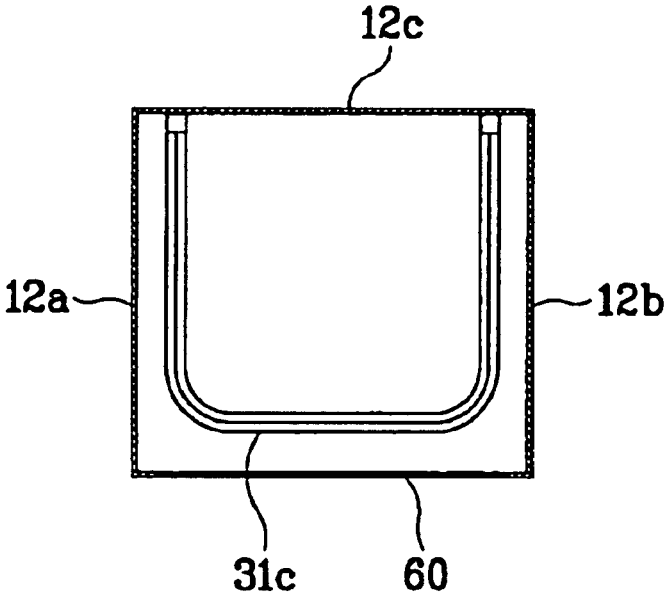
Figure 5C:
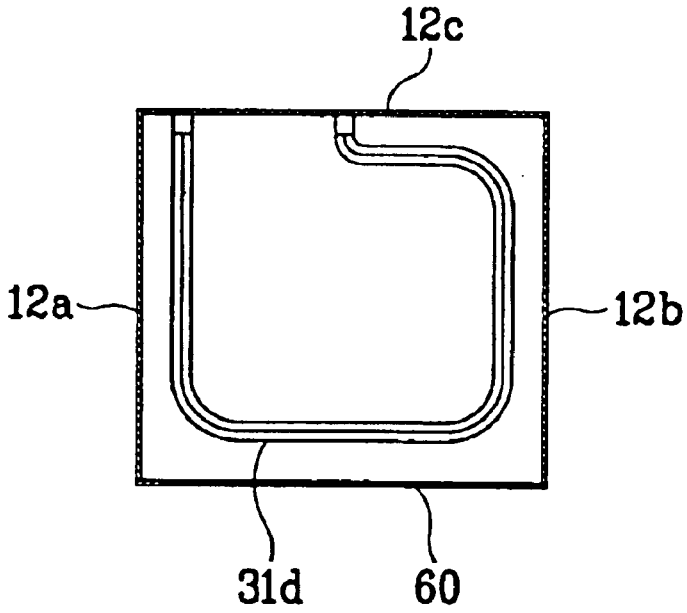
Figure 5D:
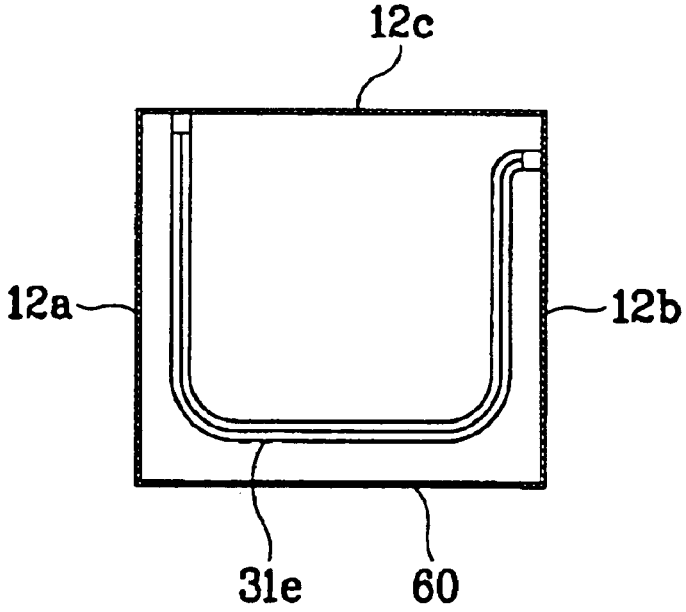

Referring to FIGS. 5B to 5D, the condenser 30 mounted on the outdoor unit 10 is installed in various shapes with a predetermined size of gaps from the side cover 12*a*, 12*b* or 12*c*, both ends of the condenser 30 are adhered to one side cover 12*c* or different side covers 12*b* and 12*c*, and condenser covers (not shown) fixedly support the condenser 30 on the side covers 12*a*, 12*b* and 12*c* at the highest end of the condenser 30. That is, a wind path for inducing external air can be formed merely by the condenser covers without using the condenser brackets, which reduces a number of the components of the outdoor unit 10.

Figure 5E:
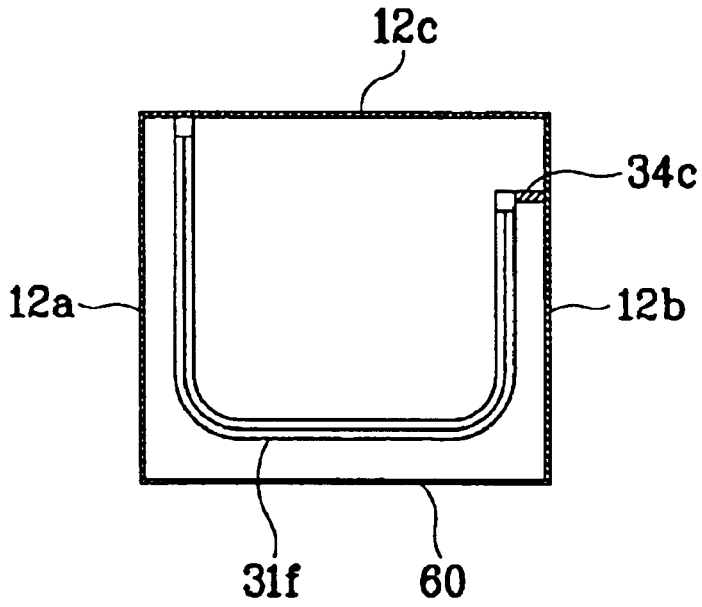
Figure 5F:
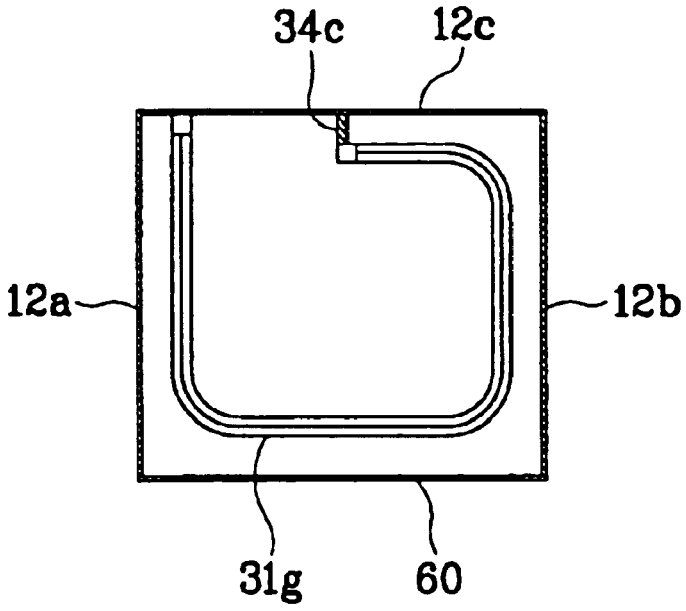

As shown in FIGS. 5E and 5F, the condenser 30 mounted on the outdoor unit 10 is installed in various shapes with a predetermined size of gaps from the side cover 12*a*, 12*b* or 12*c*, one end of the condenser 30 is adhered to the side cover 12*c* and the other end of the condenser 30 is fixedly supported on the side cover 12*b* or 12*c* by the condenser bracket 34*c*, and condenser covers (not shown) fixedly support the condenser 30 on the side covers 12*a*, 12*b* and 12*c* at the highest end of the condenser 30. That is, the condenser 30 reduces a number of the components of the outdoor unit 10, and also serves to appropriately align the components.

Figure 6A:
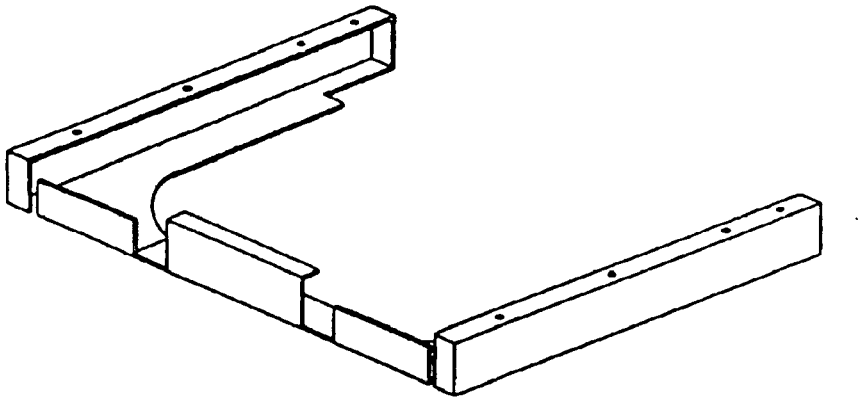
FIGS. 6A and 6B are views illustrating examples of a condenser cover.
Figure 6B:
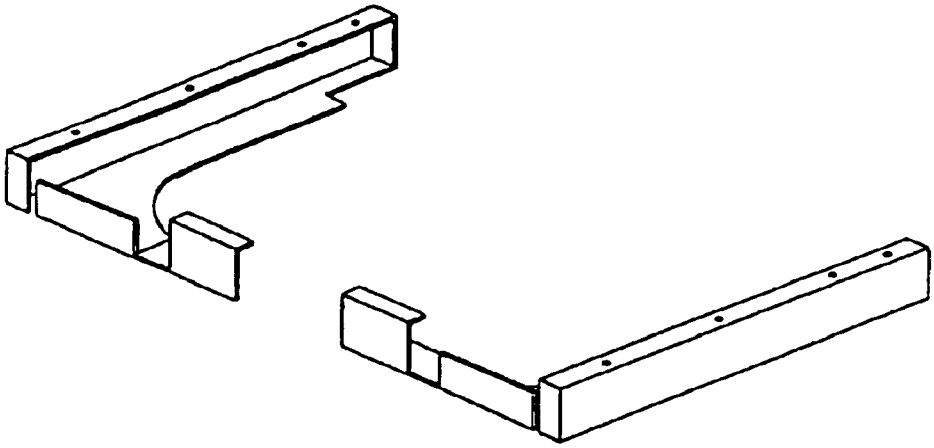

FIGS. 6A and 6B are views illustrating examples of the condenser cover. The condenser covers 32*a*, 32*b* and 32*c* of FIG. 2 include three elements, but can be incorporated or include two elements as shown in FIGS. 6A and 6B. That is, they can be modified to easily connect the highest end of the condenser 30 to the side covers 12*a*, 12*b* and 12*c*.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A front suction/discharge type compressor/condenser unit for an air conditioner, comprising:

a compressor/condenser unit casing having a front surface externally opened and its other surfaces including side surfaces closed, and installed separately from an indoor unit including an evaporator but connected to the indoor unit through refrigerant pipe lines;

a compressor installed in the compressor/condenser unit casing, for compressing a refrigerant gas supplied from the indoor unit through the refrigerant pipe lines;

an air-cooled condenser positioned in the compressor/condenser unit casing to face the front surface and face at least one side surface contacting and facing the front surface for inducing external air to gaps between the air-cooled condenser and the facing surfaces, and condensing the refrigerant gas from the compressor by external air sucked;

a cooling fan installed in the compressor/condenser unit casing, for sucking external air through the front surface and the air-cooled condenser, and discharging heat exchanged air through the front surface; and a first supporting member for fixedly supporting the air-cooled condenser on the facing surfaces at the top and/or bottom end of Thc air-cooled condenser, in order to induce external air to the gaps between the air-cooled condenser and the facing surfaces.

2. The compressor/condenser unit of claim 1, further comprising a second supporting member for fixedly supporting the air-cooled condenser on the facing surfaces at both ends of the air-cooled condenser.

3. The compressor/condenser unit of claim 1, wherein one end of the air-cooled condenser is adhered to the surface facing the front surface, and a second supporting member fixedly supports the air-cooled condenser on the surface facing the front surface at the other end of the air-cooled condenser.

4. The compressor/condenser unit of claim 1, wherein one end of the air-cooled condenser is adhered to the surface facing the from surface, and a second supporting member fixedly supports the air-cooled condenser on the surface adjacent to the surface facing the front surface and adjacent to the front surface at the other end of the air-cooled condenser.

5. The compressor/condenser unit of one of claim 1 or 2, 4, wherein the compressor/condenser unit casing is divided into a suction casing, and a discharge casing.

6. The compressor/condenser unit of claim 5, wherein the first supporting member is positioned to contact both the suction casing and the discharging casing.

7. The compressor/condenser unit of claim 6, wherein the first and second supporting members are fixedly adhered to the surfaces of the suction casing, and the lower end of the air-cooled condenser is adhered to one of the other surfaces, so that whole external air sucked through the front surface can pass through the air-cooled condenser.

8. The compressor/condenser unit of claim 1, wherein the air-cooled condenser comprises a rounded part.

9. The compressor/condenser unit of claim 8, wherein the air-cooled condenser has predetermined gaps from the facing surfaces.

10. The compressor/condenser unit of claim 9, wherein the air-cooled condenser has a 'U' shaped cross section.

11. The compressor/condenser unit of claim 10, wherein a rounded value of the 'U' shape of the air-cooled condenser is greater than a size of the gap by at least two times.

12. A front suction/discharge type compressor/condenser unit for an air conditioner, comprising:

a compressor/condenser unit casing having a front surface externally opened and its other surfaces including side surfaces closed, and installed separately from an indoor unit including an evaporator but connected to the indoor unit through refrigerant pipe lines;

a compressor installed in the compressor/condenser unit casing, for compressing a refrigerant gas supplied from the indoor unit through the refrigerant pipe lines;

an air-cooled condenser being positioned in the compressor/condenser unit casing to face the front surface and face at least one side surface contacting and facing the front surface, having its both ends adhered to at least one of the side surfaces, inducing external air to gaps between the air-cooled condenser and the facing surfaces, and condensing the refrigerant gas from the compressor by external air sucked; and a cooling fan installed in the compressor/condenser unit casing, for sucking external air through the front surface and the air-cooled condenser, and discharging heat exchanged air through the front surface.

13. The compressor/condenser unit of claim 12, wherein each end of the air-cooled condenser is adhered to one of the side surfaces.

14. The compressor/condenser unit of claim 12, further comprising a first supporting member for fixedly supporting the air-cooled condenser on the facing surfaces at the top and/or bottom end of the air-cooled condenser in order to induce external air to the gaps between the air-cooled condenser and the facing surfaces.

15. The compressor/condenser unit of one of claims 12 to 14, wherein the compressor/condenser unit casing is divided into a suction casing, and a discharge casing.

16. The compressor/condenser unit of claim 15, wherein the first supporting member is positioned to contact both the suction casing and the discharge casing.

17. The compressor/condenser unit of claim 16, wherein the first supporting member is fixedly adhered to the surfaces of the suction casing, and the lower end of the air-cooled condenser is adhered to one of the other surfaces, so that whole external air sucked through the front surface can pass through the air-cooled condenser.

18. The compressor/condenser unit of claim 12, wherein the air-cooled condenser comprises a rounded part.

19. The compressor/condenser unit of claim 18, wherein the air-cooled condenser has predetermined gaps from the facing surfaces.

20. The compressor/condenser unit of claim 19, wherein the air-cooled condenser has a 'U' shaped cross section.

21. The compressor/condenser unit of claim 20, wherein a rounded value of the 'U' shape of the air-cooled condenser is greater than a size of the gap by at least two times.

22. A front suction/discharge type compressor/condenser unit for an air conditioner, comprising a compressor/condenser unit casing having a front surface externally opened and its other surfaces including side surfaces closed, and installed separately from an indoor unit including an evaporator but connected to the indoor unit through refrigerant pipe lines;

a compressor installed in the compressor/condenser unit casing, for compressing a refrigerant gas supplied from the indoor unit through the refrigerant pipe lines;

an air-cooled condenser being positioned in the compressor/condenser unit casing to face the front surface and face at least one side surface contacting and facing the front surface, having a rounded part, inducing external air to gaps between the air-cooled condenser and the facing surfaces, and condensing the refrigerant gas from the compressor by external air sucked; and a cooling fan installed in the discharge unit of the outdoor unit casing, for supplying external air to the air-cooled condenser, and discharging heat exchanged air, wherein the air-cooled condenser has predetermined gaps from the facing surfaces, and wherein a rounded value of the rounded part of the air-cooled condenser is greater than a size of the gap by at least two times.

23. The compressor/condenser unit of claim 22, wherein the air-cooled condenser has a 'U' shaped cross section.

24. The compressor/condenser unit of claim 23, wherein a rounded value of the 'U' shape of the air-cooled condenser is greater than a size of the gap by at least two times.

25. The compressor/condenser unit of claim 22, further comprising a first supporting member for fixedly supporting the air-cooled condenser on the facing surfaces at the top and/or bottom end of the air-cooled condenser in order to induce external air to the gaps between the air-cooled condenser and the facing surfaces.

26. The compressor/condenser unit of claim 25, wherein the compressor/condenser unit casing is divided into a suction casing, and a discharge casing.

27. The compressor/condenser unit of claim 26, wherein the first supporting member is positioned to contact both the suction casing and the discharge casing.

28. The compressor/condenser unit of claim 25, further comprising second supporting member for fixedly supporting the air-cooled condenser on the facing surfaces at both ends of the air-cooled condenser.

29. The compressor/condenser unit of claim 25, wherein one end of the air-cooled condenser is adhered to the surface facing the front surface, and a second supporting member fixedly supports the air-cooled condenser on the surface facing the front surface at the other end of the air-cooled condenser.

30. The compressor/condenser unit of claim 25, wherein one end of the air-cooled condenser is adhered to the surface facing the front surface, and a second supporting member fixedly supports the air-cooled condenser on the surface adjacent to the surface facing the front surface and adjacent to the front surface at the other end of the air-cooled condenser.

31. The compressor/condenser unit of one of claims 28 to 30, wherein the first and second support members are fixedly adhered to the surfaces of the casing, and the lower end of the air-cooled condenser is adhered to one of the other surfaces, so that whole external air sucked through the front surface can pass through the air-cooled condenser.

32. The compressor/condenser unit of claim 25, wherein both ends of the air-cooled condenser are adhered to at least one of the other surfaces.

33. The compressor/condenser unit of claim 32, wherein the first supporting member is fixedly adhered to the surfaces of the casing, and the lower end of the air-cooled condenser is adhered to one of the other surfaces, so that whole external air sucked through the front surface can pass through the air-cooled condenser.

34. A front suction/discharge type compressor/condenser unit for an air conditioner, comprising:

a compressor/condenser unit casing having a front surface externally opened and its other surfaces including side surfaces dosed, and installed separately from an indoor unit including an evaporator but connected to the indoor unit through refrigerant pipe lines;

a compressor installed in the compressor/condenser unit for compressing a refrigerant gas supplied from the indoor unit through the refrigerant pipe lines;

an air-cooled condenser being positioned in the compressor/condenser unit casing and having a rounded part, and for inducing external air sucked through one surface for heat exchange, and condensing the refrigerant gas from the compressor by the sucked external air; and a cooling fan installed in the discharge unit of the outdoor unit casing, for supplying external air to the air-cooled condenser, and discharging heat exchanged air, wherein the air-cooled condenser is positioned in the suction unit such that predetermined gaps exist between the rounded part of the air-cooled condenser and side surfaces of the suction unit.

35. The compressor/condenser unit of claim 34, wherein the predetermined gaps have a size that is selected based on a radius of the rounded part of the air-cooled condenser.

36. The compressor/condenser unit of claim 35, wherein the air-cooled condenser has a 'U' shaped cross section.

37. The compressor/condenser unit of claim 36, wherein the radius of the 'U' shape of the air-cooled condenser is greater than the size of the predetermined gaps by at least two times.

38. The compressor/condenser unit of claim 34, wherein the predetermined gaps are configured to allow air to pass through the air-cooled condenser via the predetermined gaps between the side surfaces of the suction unit.

* * * * *